United States Patent [19]

Kelly et al.

[11] 3,978,666

[45] Sept. 7, 1976

[54] VEHICLE SPEED CONTROL APPARATUS AND METHOD

[75] Inventors: Kenneth W. Kelly, Warrensburg; Wayne A. Peterson, Washington, both of Ill.

[73] Assignee: Caterpillar Tractor Co., Peoria, Ill.

[22] Filed: Sept. 11, 1975

[21] Appl. No.: 612,428

[52] U.S. Cl. ..... 60/327; 60/468; 60/459; 91/444

[51] Int. Cl.[2] ..... F15B 15/18

[58] Field of Search ..... 60/327, 468, 494, 459; 91/461, 444; 137/118

[56] References Cited

UNITED STATES PATENTS

| | | | |
|---|---|---|---|
| 2,043,453 | 6/1936 | Vickers | 60/468 X |
| 2,102,865 | 12/1937 | Vickers | 60/468 X |
| 2,447,441 | 8/1948 | Tweedale | 60/468 |
| 3,153,900 | 10/1964 | Pigeroulet et al. | 60/468 X |
| 3,550,617 | 12/1970 | Johnson | 137/514.5 |
| 3,576,104 | 4/1971 | Kokaly et al. | 60/429 |

*Primary Examiner*—Edgar W. Geoghegan
*Attorney, Agent, or Firm*—Frank L. Hart

[57] ABSTRACT

Apparatus and method for controlling the velocity of an engine driven vehicle having a hydraulic system pump driven by the engine. Means are provided for controllably restricting the passage of fluid from the pump of the hydraulic system for controllably loading the engine and thereby controlling the velocity of the vehicle.

7 Claims, 3 Drawing Figures

VEHICLE SPEED CONTROL APPARATUS AND METHOD

BACKGROUND OF THE DISCLOSURE

Various work vehicles, such as motor graders, scrapers, and the like, often work in mountainous terrain where the rate of descent of their work surface is sometimes excessively rapid. It is necessary for the operator to utilize his vehicle braking system in order to maintain adequate control over the vehicle while working on such a relatively steep grade. Where these descending work surfaces are of long lengths, the braking system often experiences an undesirable amount of heat and wear.

It is therefore desirable to provide apparatus and method for controlling the vehicle speed through engine loading with an apparatus that is easily installed on a vehicle expected to be used on steep grades.

This invention therefore resides in apparatus and method for controlling the velocity of an engine driven vehicle having a hydraulic system pump driven by the engine. Means are provided for dividing fluid from the pump into two streams and controllably restricting the flow of the stream relative one to the other and controllably restricting the passage of fluid from the pump for controllably loading the engine through the pump and thereby controlling the velocity of the engine on response thereto.

DETAILED DESCRIPTION OF THE INVENTION

Figure 1:
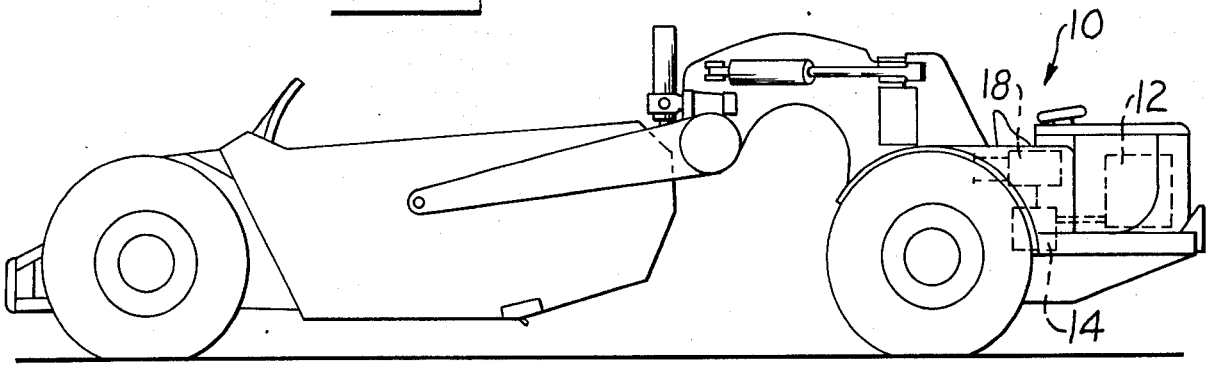
FIG. 1 is a diagrammatic view of a vehicle having the apparatus of this invention.

Referring to FIG. 1, a vehicle 10, such as a scraper, has an engine 12 connected to the vehicle wheels through a power train for powering the mobile vehicle. As is known in the art, the engine 12 also provides power for auxiliary equipment of the vehicle 10. Further, the engine 12 is connected to a pump 14 of a hydraulic system 16 and the hydraulic system 16 is utilized in the operation of some of the auxiliary equipment of the vehicle.

It should be understood, however, that the vehicle can be a tracklaying vehicle without departing from this invention. The term "wheels" will be hereafter used, however, for purposes of brevity.

Figure 2:
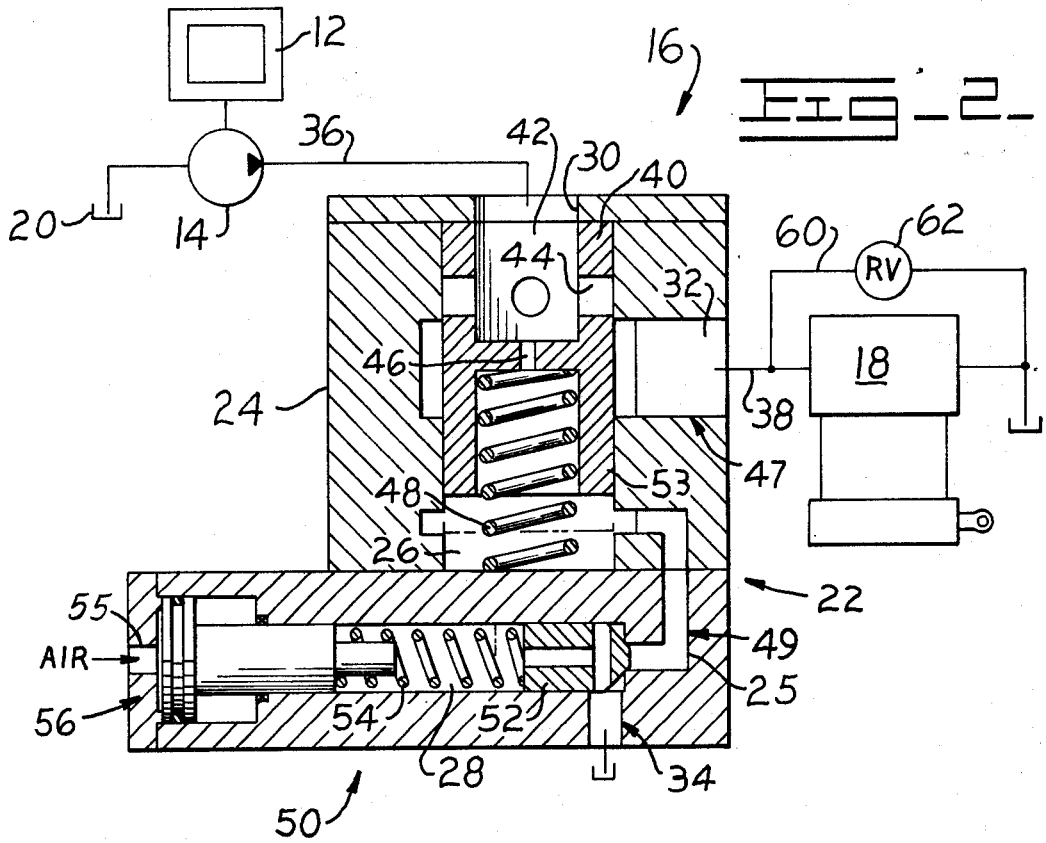
FIG. 2 is a diagrammatic view in partial section of the apparatus of this invention.

Referring to FIG. 2, the pump 14 is connected to a control valve 18 of the hydraulic system 16 for delivering hydraulic fluid from a tank 20 to the control valve 18 for operating auxiliary equipment of the vehicle, such as a scraper blade (not shown). The pump 14 is connected to the control valve 18 via the retarder valve 22.

The retarder valve 22 has a valve body 24, first and second chambers 26, 28, a fluid inlet 30, and first and second fluid outlets 32, 34. The fluid inlet 30 is connected to the pump 14 and the first fluid outlet 32 is connected to the control valve 18 via respective lines 36 and 38 for forming a first fluid pathway 47 through the valve body 24. The second fluid outlet 34 is in fluid communication with the fluid inlet 30 via the first chamber 26 and line 25 for forming a second fluid pathway 49 through the valve body 24.

A restrictor spool valve 40 having an inlet 42 and first and second outlets 44, 46 slides in the first chamber 26 of the valve body 24. The restrictor spool valve 40 is movable within the first chamber 26 between a first position (shown) at which the first restrictor spool outlet 44 is substantially closed and a second position (shown by broken lines) at which the first restrictor spool outlet 44 is open to a greater degree and in fluid communication with the first outlet 32 of the valve body 24.

At the first position of the restrictor spool valve 40, the first fluid pathway 47 to the control valve 18 is substantially closed, and at the second position of the restrictor spool valve 40 the first fluid pathway 47 is substantially wide open. As will be understood from a study of the drawing, at controlled intermediate positions of the restrictor spool valve 40 the first fluid pathway 47 is open to varying degrees.

Resilient spring means, such as a helical spring 48, is positioned in the first chamber 26 for mechanically biasing the restrictor spool valve 40 toward the first position. Means, such as the second portion of the retarder valve 22 generally indicated by numeral 50, is provided for controlling the passage of fluid through the second fluid pathway 49, from the second restrictor spool outlet 46, through the lower portion of chamber 26 and the second valve body outlet 34.

Figure 3:
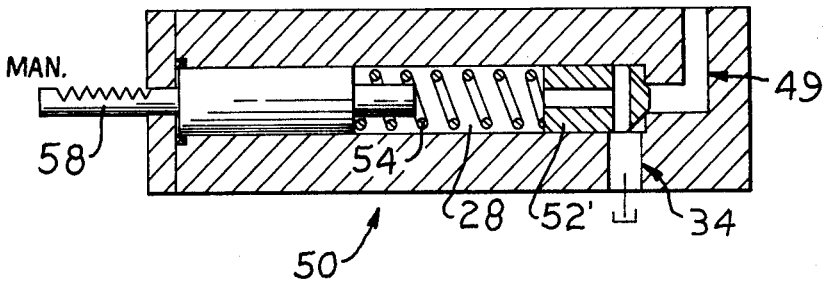
FIG. 3 is a diagrammatic view in partial section of another embodiment of a portion of the apparatus of this invention.

The means for controlling the passage of fluid through the second fluid pathway 49 and outlet 34 can be a pneumatically actuated poppet 52, as shown in FIG. 2, or a mechanically actuated poppet 52', as shown in FIG. 3.

Referring to FIG. 2, the poppet 52 slides in the second chamber 28 for movement between a first position (shown by broken lines) at which the poppet 52 is spaced from the second fluid pathway 49 and a second position (shown in FIG. 3) at which the poppet 52' is in the second fluid pathway 49 blocking the flow of fluid through the second fluid outlet 34. As can be seen from a study of the drawings, at intermediate positions of the poppet 52 or 52', the flow of fluid through the second fluid outlet 34 is controllably restricted.

Resilient spring means, such as helical spring 54, is positioned in the second chamber 28 for mechanically biasing the poppet 52 toward the second position.

In the embodiment of FIG. 2, a pneumatically actuated cylinder 56 is associated with the poppet 52 for controllably imparting an additional force on the poppet 52, via spring 54, in a direction sufficient for urging the poppet 52 toward the second position.

In the embodiment of FIG. 3, the additional force is controllably imparted onto the poppet 52' via the spring 54 by a mechanically operated push rod 58.

In the operation of the vehicle on relatively level ground where a large amount of braking is not needed, the retarding valve 22 is not actuated.

During operation of the vehicle, the engine is operating the hydraulic system pump 14 which is recovering hydraulic fluid from the tank 20 and discharging it at elevated pressure into line 36 for passage into the retarding valve 22. The fluid passes through the valve 22 and into control valve 18 where it is routed to various auxiliary apparatus of the vehicle for the hydraulic operation thereof.

In the inactivated mode of the retarding valve 22, the pressure from the hydraulic fluid is exerted against the restrictor spool valve 40. The hydraulic force exerted on the restrictor spool 40 is greater than the force of spring 48 and thereby maintains the restrictor spool valve 40 at the second position at which the control valve 18 is in relatively unrestricted fluid communication with the pump 14. In this inactivated mode, the poppet 52 is in a position at which the outlet of the second fluid pathway 49 is partially restricted, thereby providing a pathway for fluid to controllably pass at a low rate through orifice 46 and the second fluid pathway 49.

Where high pressures are expected to be delivered to the control valve 18 in the inactivated mode of the retarding valve 22, it may be desirable to provide the restrictor spool valve 40 with a skirt 53 that partially restricts the passage of fluid through the second fluid pathway 49 at the second position of the restrictor spool valve 40. This skirt 53 thus functions to controllably reduce the passage of fluid through the second fluid pathway 49, thereby providing delivery of substantially all of the fluid through the first fluid pathway 47 and to the control valve 18.

As the operator approaches a steep downward grade, he can acutate the retarding valve 22 for controllably loading the engine 12 through the pump 14, thereby controllably braking the vehicle through the engine 12.

In the embodiment of FIG. 2, air, or liquid if desirable, is delivered via line 55 to the cylinder 56 to actuate the retarding valve 22 and exert a force on the poppet 52 of sufficient magnitude to move the poppet 52 to the second position, thereby closing the outlet 34 of the second fluid pathway 49. In response to closing the second fluid pathway 49, the pressure on opposed ends of the restrictor spool valve 40 equalizes which permits the spring 48 to move the restrictor spool valve 40 to the first position at which the first fluid outlet 32 is substantially closed. The pump 14 is then delivering fluid to the control valve 18 and working against a substantially closed system which causes the pump 14 to work against a higher pressure, thus loading the engine 12 and reducing the velocity of the vehicle 10 in response thereto.

As can be seen by a study of the drawings and the above, the pump 14 and the engine 12 can be controllably loaded to varying degrees in response to and relative to the additional force that is exerted on the poppet 52.

After the vehicle has returned to level ground, the operator can deactuate the retarding valve 22 by releasing the pressure exerted on the poppet 52 or 52' by the cylinder 56 or push rod 58. The elevated fluid pressure is the second fluid pathway 49 causes the poppet 52 to move to the first position and open the secod fluid pathway 49 to drain. As fluid drains from the second fluid pathway 49, the fluid pressure below the restrictor spool valve 40 is reduced and the restrictor spool valve is driven to the second position at which location the pump 14 is in greater fluid communication with the control valve 18. The pump 14 is operating against relatively low pressure, and the load on the engine 12 through the pump 14 is relieved.

Other aspects, objects and advantages of this invention can be obtained from a study of the disclosure and appended claims.

What is claimed is:

1. Apparatus for controlling the velocity of an engine driven vehicle having a control valve connected to a hydraulic system pump driven by said engine, comprising:

a valve body having first and second chambers, a fluid inlet connected to the pump and opening into the first chamber, a first fluid outlet connected to the control valve and opening into the first chamber, and a second fluid outlet through the valve body and opening into the first chamber;

a restrictor spool valve having an inlet, first and second outlets and being movable in the first chamber between a first position at which the first restrictor spool outlet is substantially closed and a second position at which the first restrictor spool outlet is open to a greater extent and in fluid communication with the first outlet of the valve body;

means biasing the restrictor spool toward the first position; and means for controlling the passage of fluid through the second restrictor spool valve outlet and the second valve body outlet for further biasing the restrictor spool valve toward the first position.

2. Apparatus, as set forth in claim 1, wherein the biasing means is a resilient spring means.

3. Apparatus, as set forth in claim 1, wherein the means for controlling the passage of fluid from the second valve body outlet comprises:

a poppet positioned in the second chamber and being movable between a first position spaced from the second fluid outlet of the valve body and a second position closing the second fluid outlet of said valve body;

means for biasing the poppet toward the second position; and means for controllably imparting an additional force on the poppet in a direction for urging the poppet toward the second position.

4. Apparatus, as set forth in claim 3, wherein the biasing means of the poppet is a resilient spring means.

5. Apparatus, as set forth in claim 3, wherein the means for imparting the additional force on the poppet is a pneumatic cylinder.

6. Apparatus, as set forth in claim 3, wherein the means for imparting the additional force on the poppet is a mechanically actuated push rod.

7. A method for controlling the velocity of an engine driven vehicle having a hydraulic system pump driven by said engine, comprising:

dividing a fluid stream from the pump into first and second fluid streams; and controllably restricting the flow of the first and second streams relative one to the other and controllably restricting the passage of fluid from the pump for controllably loading the engine through the pump and thereby controlling the velocity of the vehicle in response thereto.

* * * * *